US006564795B1

(12) United States Patent
Sears et al.

(10) Patent No.: US 6,564,795 B1
(45) Date of Patent: May 20, 2003

(54) AIR BAFFLE ATTACHMENT TO A HEAT EXCHANGER

(75) Inventors: Merle Dana Sears, Mooresville, IN (US); Stephen Leon Pulley, Carmel, IN (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/041,099

(22) Filed: Jan. 9, 2002

(51) Int. Cl.[7] ..... F24H 3/00; F28F 3/14; F28D 7/00

(52) U.S. Cl. ..... 126/110 R; 126/99 D; 165/170; 165/159

(58) Field of Search ..... 126/110 R, 99 D; 165/170, 159, 401

(56) References Cited

U.S. PATENT DOCUMENTS 4,147,153 A * 4/1979 Buckner ..... 126/521
4,185,610 A * 1/1980 Buckner ..... 126/521
4,651,711 A * 3/1987 Velie ..... 126/110 C
5,333,597 A * 8/1994 Kirkpatrick et al. .... 126/110 R
5,370,529 A * 12/1994 Lu et al. ..... 431/353
5,448,986 A * 9/1995 Christopher et al. .... 126/110 R

* cited by examiner

*Primary Examiner*—Henry Bennett
*Assistant Examiner*—Alfred Basichas

(57) ABSTRACT

A clamshell heat exchanger panel has a pocket formed in an edge of a land portion of the panel so that a fastener can be inserted into the pocket, with its axis in the plane of the heat exchanger panel. This allows attachments to be made directly to the exchanger panel without affecting the integrity of the gas- carrying conduit portion of the panel. The pocket is made by forming mirror image indentions in the land portions of the two sides of a sheet metal workpiece such that, when the two sides are folded together, the indentions cooperate to form the pocket. Openings can also be formed through the land portions of the two sides so that, upon a folding together, the openings define an opening into the pocket.

10 Claims, 5 Drawing Sheets

AIR BAFFLE ATTACHMENT TO A HEAT EXCHANGER

BACKGROUND OF THE INVENTION

This invention relates generally to furnaces and, more particularly, to a method and apparatus for attaching an air baffle to a furnace heat exchanger.

Residential furnaces typically include a plurality of heat exchanger panels or cells arranged in parallel relationship, with the air,to be heated being circulated by a blower so as to pass between the panels and over the surfaces of the panels, to be heated. The panels have associated burners for heating the air within the panels, and an inducer may be employed to draw the heated air through the panels and discharge them to a flue.

In order to improve the heat transfer efficiency of the furnace heat exchangers and maintain a more uniform distribution of temperatures across the surfaces of the heat exchangers, it has become common practice to use baffles to selectively channel the flow of circulating air over the heat exchanger surfaces. For example, a blower shelf baffle has been provided to turn a horizontal component of the circulating air coming off the fan to flow in a more vertical upward direction. Also, sidewall baffles have been used to break up the laminar flow along the sidewalls and redirect it outwardly toward the heat exchangers. Similarly, a rear wall baffle has been used for diverting the flow of air away from the rear wall and outwardly toward the heat exchanger panels. In each case, it has generally been the practice to attach these baffles to the furnace casing or to the blower shelf by fasteners or the like.

While the rear wall baffle may comprise a single element extending continuously across the rear wall so as to uniformly channel the airflow outwardly, it preferably includes a plurality of baffle elements that are selectively spaced across the rear wall in relation to be spacing of the heat exchanger panels. That is, the baffles extend outwardly beyond the rear edges of the heat exchanger panel structures so as to collectively wrap around those edges to more effectively channel the airflow as desired. With this feature, the baffles can also serve a second function of maintaining proper spacing between panels by engaging the edges of the panels on either side thereof. However, if the heat exchanger panels move with respect to the rear wall, as tends to occur because of the significant volume of circulating air flowing thereover, then the movement between the baffles and the panels will cause undesired noise and possible misalignment.

One form of heat exchanger that is commonly used in such furnaces is a so-called clamshell heat exchanger, wherein two stamped metal shells are fastened together to form a single panel having a plurality of serpentine passages, or passes, through which the hot gases can be caused to flow. Thus, the panels are generally rectangular in form, and have a border and portions between the passages which are planar in form and made up of two thicknesses of sheet metal pressed together. These portions can be referred to as lands. Since the lands are not part of the structure which carries the hot gases, they are available for purposes of attaching a baffle to the panels. However, it is difficult to attach a fastener that extends normally through the lands at the border portion of the panel because of the limited distance between adjacent panels. And, heretofore, there has been no way to attach a fastener that extends in the plane of the respective panels In a serpentine, clamshell exchanger panel, a burner heats the air at an inlet end thereof, and the hot gases pass through successive passes and finally come out of the exit end of the panel to eventually be discharged to the flu. As the gases pass from the inlet to the exit end of the panel, they are cooled by the air being circulated over the surface of the panel. Thus, the gases in the first pass are at substantially higher temperatures than those downstream thereof, and care must be taken to prevent the occurrence of excessive temperatures. In particular, hot spots are most likely to occur in the vicinity between the first return bend and the second pass. These hot spots cause exposure to high temperatures that can cause excessive strain levels in the material of the heat exchanger structure and may eventually lead to failure.

It is therefore an object of the present invention to provide an improved method and apparatus for mounting a rear wall baffle in a furnace. This object and other features and advantages become more readily apparent upon reference to the following descriptions when taken in conjunction with the appended drawings.

SUMMARY OF THE INVENTION

Briefly, in accordance with one aspect of the invention, a pocket is provided in the rear border, land portion of each of the heat exchanger panels for inserting a fastener therein for purposes of attaching a rear wall baffle thereto. The baffles are then rigidly connected to the heat exchanger panels and are free to move with those panels such that there is no relative movement between the panels and the baffles.

In accordance with another aspect of the invention, the pockets are formed with their axes being in the plane of the respective panel's structure and without disrupting the integrity of the internal flow path of the heat exchanger panels. This is accomplished by forming mirror image indentions in each half of the sheet metal stamping prior to its being folded into a clamshell structure. An opening between the indentions and at the fold line can also be formed at that time. Upon folding the two halves together, a pocket is formed for receiving a fastener therein.

In accordance with yet another aspect of the invention, the attached baffle structure can be extended by attaching thereto another baffle which extends between, but does not engage, the heat exchanger panels on either side thereof, and is so positioned so as to divert a substantial amount of the circulating air over a specific area of the heat exchanger panel which would otherwise have hot spots occurring therein.

In the drawings as hereinafter described, a preferred embodiment is depicted; however, various other modifications and alternate constructions can be made thereto without departing from the true spirit and scope of the invention.

BRIEF DESCRIPTION OF THE DRAWINGS

FIG. 1 is a perspective view of the present invention as incorporated into a furnace heat exchanger assembly in accordance with the present invention to the.

DESCRIPTION OF THE PREFERRED EMBODIMENT

Figure 1:
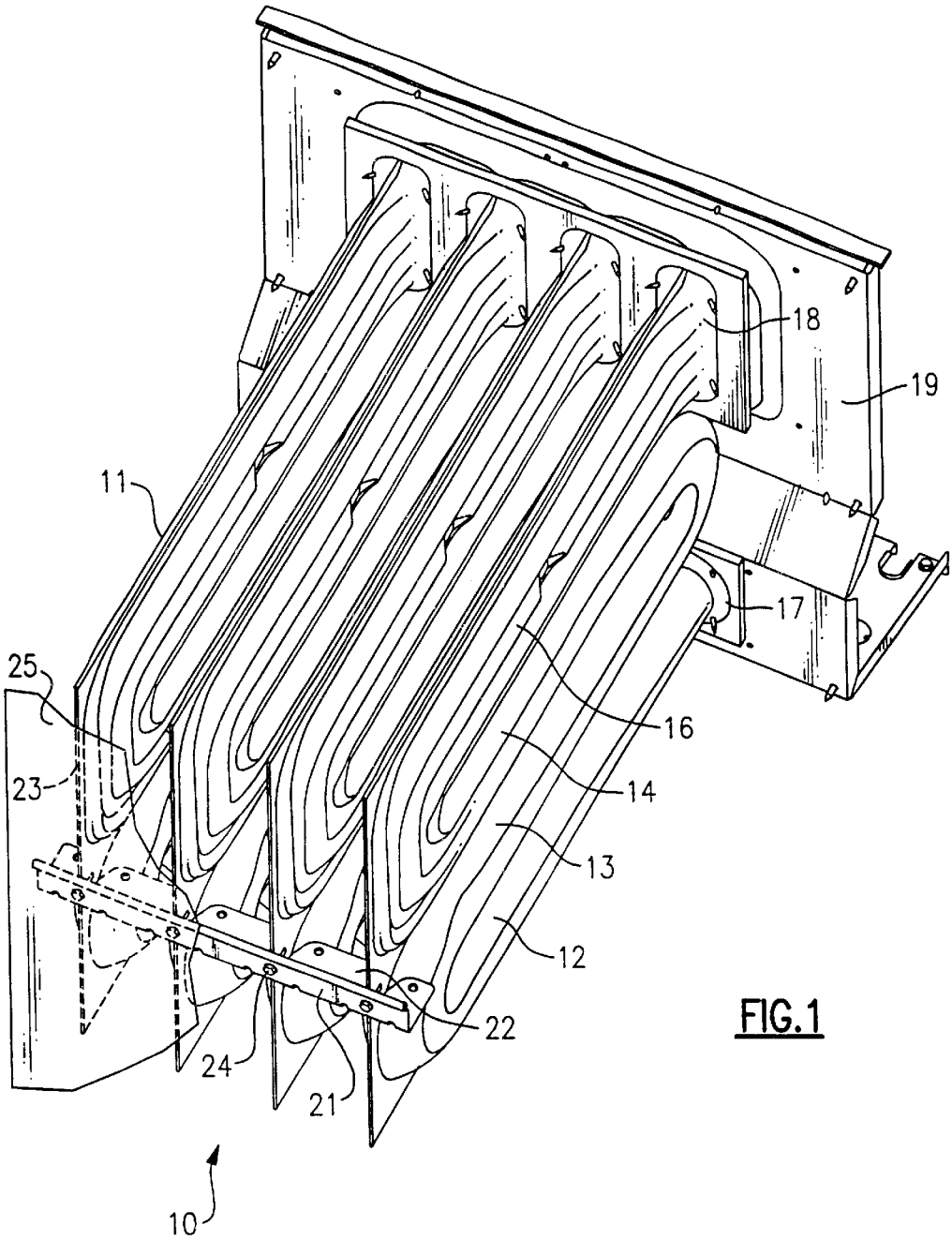

Referring now to FIG. 1, the invention is shown generally at 10 as applied to a plurality of clamshell heat exchanger panels 11 which are installed in an otherwise conventional gas-fired furnace with air being circulated upwardly across of the surfaces of the panels 11 by way of a fan which is mounted therebelow (not shown). Each of the heat exchanger panels 11 has a plurality of serpentine passes through which the hot gases are caused to flow. The first, second, third and fourth passes are indicated at 12, 13, 14 and 16, respectively. Each panel 11 has an inlet end 17 and an outlet end 18, and both the inlet end 17 and the outlet end 18 are attached by fasteners or the like, to a front cell panel 19. The cell panel 19 is, in turn, attached to the framework of the furnace casing, so that of the individual heat exchanger panels 11 are fully supported by the cell panel 19. For each cell panel 19, a burner is attached near the inlet end 17 to introduce heat into the first pass 12, and the outlet end 18 is made to fluidly communicate with an inducer, which draws the hot air through the various passages of the heat exchanger panel 11 and discharges the cooled gases to a flue downstream thereof in a conventional manner.

In accordance with the present invention, a bracket 21, having a plurality of baffles 22, is attached to the rear edges 23 of the heat exchanger panels 11 by way of a plurality of fasteners 24. Of the purpose of the baffles 22 is to channel of the circulation air that is flowing upwardly from a fan below, away from a furnace rear wall 25, which is in close disposition to the rear edges 23. The details of these bracket 21 and baffles 22 and their manner of attachment will be more fully described hereinafter. But first, the structure of the heat exchanger panels 11 will be described.

Figure 2:
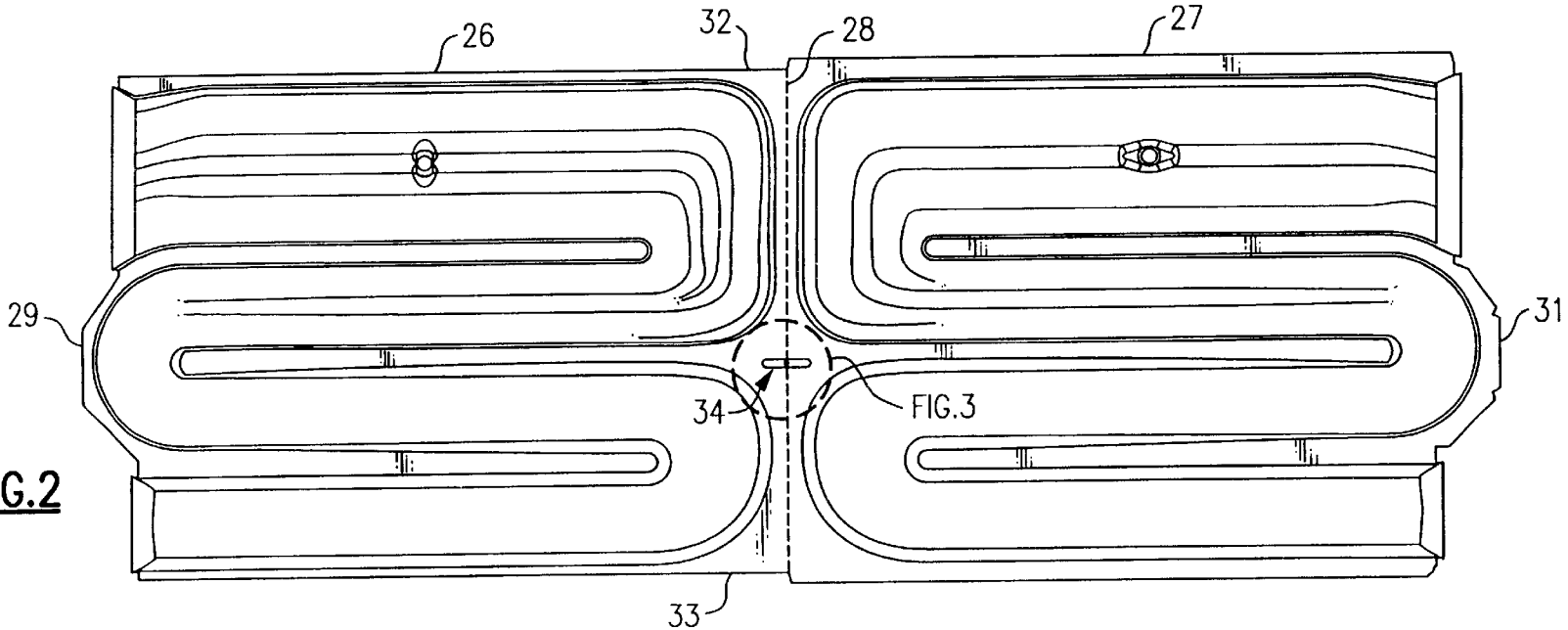
FIG. 2 is a plan view of a sheet metal stamping for a clamshell heat exchanger prior to the folding of the two sides together.
Figure 3:
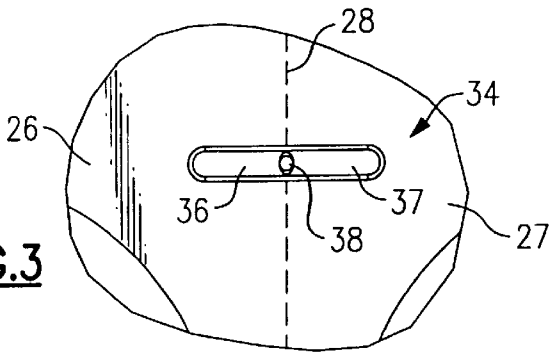
FIG. 3 is a plan view of the pocket indentions portion thereof.

In the formation of a clamshell heat exchanger, it is common practice to begin with a generally rectangular shaped piece of sheet metal, which is then stamped to form the two halves of the serpentine passageway, with the stamping then being folded in the middle to bring the two halves together to form the final passageway. Reference is made to FIG. 2 wherein the two halves are shown at 26 and 27 with a fold line 28 therebetween. As will be seen, each side 26 and 27 has a serpentine shape stamped therein, with one being the mirror image of the other and having four passes. When the piece is folded at the fold line 28, the stamped portions cooperate to form the serpentine passageway for carrying the hot gases from the inlet end 17 to the outlet end 18. At those land areas 29 where no stamping has occurred, i.e. at the edges and in those areas between the various passes, the folding of the two sides 26 and 27 result in a two ply structure with two thicknesses of the sheet metal pressed together. In the vicinity of the fold line 28, the fold itself will hold those two thicknesses together. At the other end, (that is, at the coming together of the two ends 29 and 31 as shown in FIG. 2), as well as the lateral edges 32 and 33, it is necessary to provide some fastening means to secure the two halves together to prevent leakage of the hot gases from the serpentine passageway. This is usually done by crimping or the like. Reflecting back to the stamping process, in addition to the serpentine shapes that are stamped into the two halves 26 and 27, additional shapes are stamped in the two halves 26 and 27 for the purpose of forming a fastening pocket in accordance with the present invention. That is, in the general area between the second and the third pass, and extending generally normally across the fold line 28, additional stampings are made as shown generally at 34 in FIG. 2 and in greater detail in FIG. 3. In particular, small indentions 36 and 37 on made in the sides 26 and 27, respectively, with the two indentions being continuous across the fold line 28. In addition, a small opening 38 is formed through the sheet metal, where the two indentions 36 and 37 meet, on the fold line 28.

Figure 4:
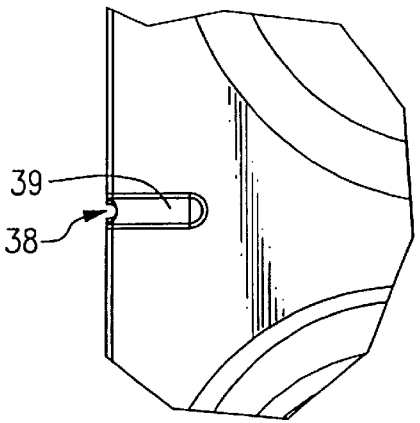
FIG. 4 is a plan view of the pocket indentions portion thereof after the folding of the two sides together.
Figure 5:
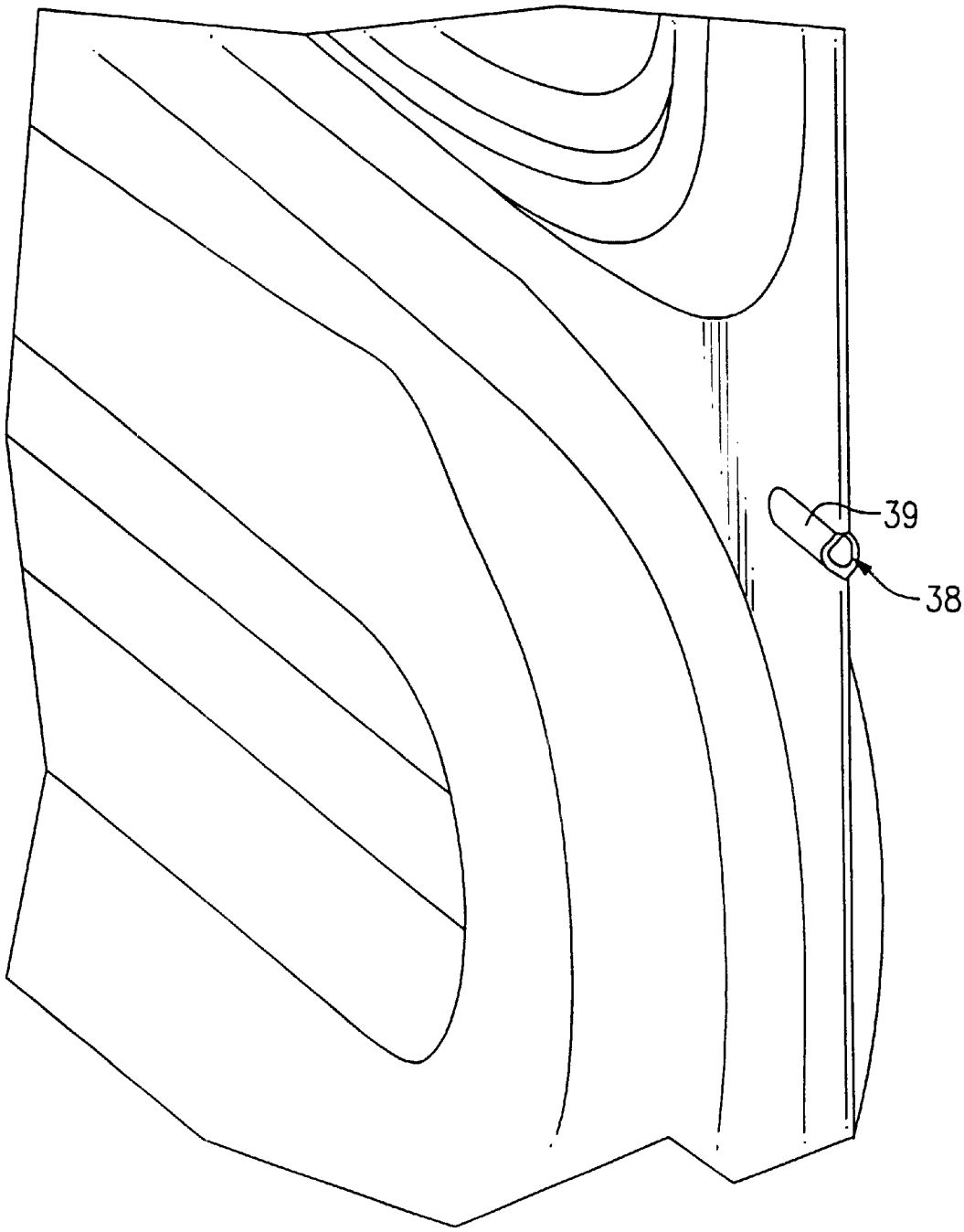
FIG. 5 is a perspective view thereof.

The two indentions 36 and 37 on generally semicircular in form such that, when the stamped sheet metal is folded at the fold line 28, the two indentions 36 and 37 form the two sides of a pocket 39 with the access opening 38 as shown in FIGS. 4 & 5. The pocket 39 is then suitable for receiving a fastener which can be installed through the opening 38. Since the pocket 39 is located only in the land portion of the panel and is therefore isolated from the serpentine channel portion thereof, any leakage of gases is unlikely to occur, especially after a fastener is installed in the opening 38. However, recognizing that the two sides 26 and 27 are simply folded together and are not actually fastened together except at their edges, it is possible that some leakage could occur between the two sides and eventually reach the pocket 39. Accordingly, in order to obtain added protection against leakage, a sealant such as Tox ed may be installed in the area surrounding the fastener.

Figure 6:
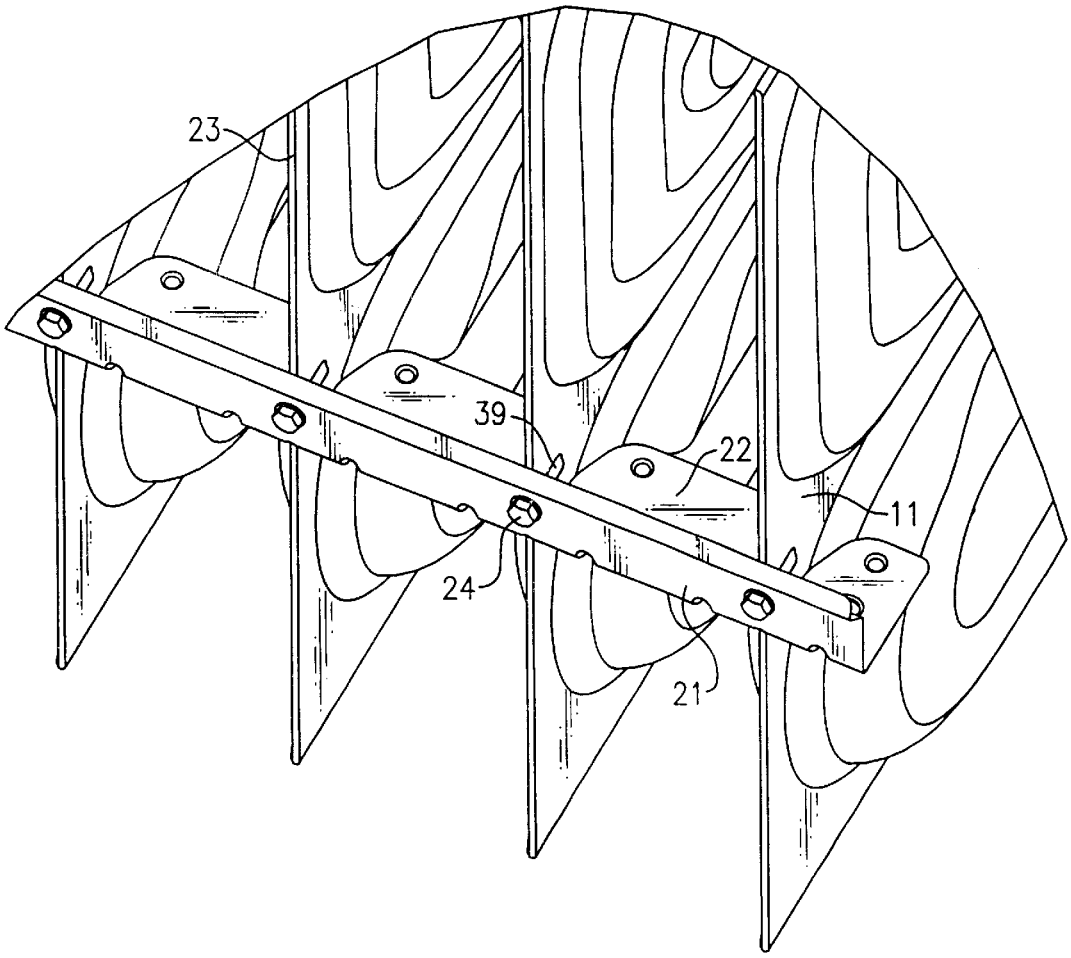
FIG. 6 is a perspective view of a baffle bracket as attached to heat exchanger panels in accordance with the present invention.
Figure 7:
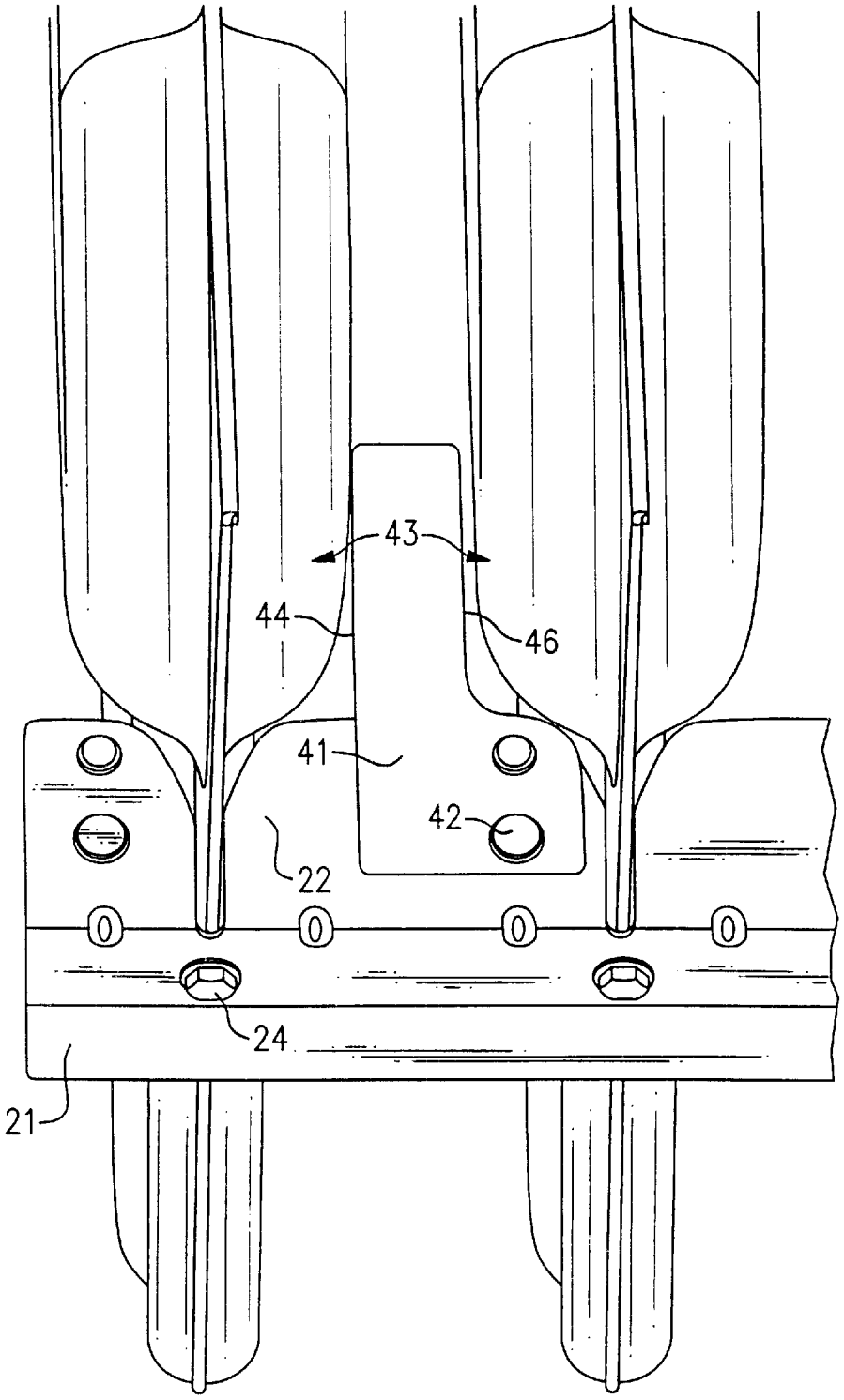
FIG. 7 is a perspective view thereof with an additional baffle element attached thereto.

Having described the pocket 39 and the manner of its forming, let us again look at the manner in which a bracket 21, with its attached baffles 22, is attached to the cell panels 11 as shown in FIG. 6. As will be seen, each of the cell panels 11 has a pocket 39 formed in its rear edge 23. The baffle 21 is positioned against the edges 23 with its baffles 22 being installed between, and in direct engagement with, the sides of the heat exchanger panels 11 to thereby establish their relative positions and also to direct the flow of circulating air away from the rear wall of the furnace. The fasteners 24 are passed through holes in the bracket 21 and into the pockets 39 to rigidly secure the bracket 21 in place.

While the baffles 22 function to channel the circulation airflow into areas adjacent to the heat exchanger panels where the heat can be more effectively transferred thereto, they do little to prevent the occurrence of hotspots on the surfaces of the heat exchanger panels 11. An additional baffle, hereinafter referred to as a finger baffle 41, is attached to the baffle structure 22 by fasteners or welds 42 or the like. The finger baffle 41 extends between, but not in direct engagement with the two heat exchanger panels 11 on either side thereof. Its purpose is to direct the flow of circulation air to the locations shown at 43 where hotspots would otherwise occur. Generally this is at the beginning of the second pass. Accordingly, the positioning of the finger baffle 41 is critical in ensuring that the circulation air spills over its longitudinal sides 44 and 46 onto the temperature sensitive areas 43 for the cooling thereof. Since the baffle structure 22 is fixed with respect to the cell panels 11, and the finger baffle 41 is fixed relative to the baffle 22, this critical positioning is ensured While the present invention has been described with reference to a preferred embodiment, it should be recognized that the invention is not limited to those precise embodiments. Rather, many modifications and variations would present themselves to a person skilled in the art without departing from the true scope and spirit of this invention. For example, while the invention has been described in terms of a pocket formed in the vicinity of the fold line which eventually becomes the rear edge of the panel, such a pocket may also be formed at other edges of the heat exchanger panels where it may be desirable to install fasteners.

What is claimed is:

1. A baffle arrangement for a furnace of the type having a plurality of heat exchanger panels aligned in parallel relationship for the transfer of heat from hot gases flowing internally therein to air being circulated over the outer surfaces thereof, said panels each having inlet and outlet openings connected to a front cell panel and having a rear edge disposed near a rear wall of the furnace, comprising a bracket extending substantially transversely across said panel rear edges;

at least one baffle member attached to said bracket and so positioned as to direct a portion of the circulated air away from said rear wall and toward said heat exchanger panels; and fastening means for securing said bracket to said panel rear edges.

2. A baffle arrangement as set forth in claim 1 wherein said at least one baffle member is substantially planar in form.

3. A baffle arrangement as set forth in claim 1 wherein said baffle member includes a plurality of slots formed therein for engagingly receiving respective flange portions of said panel rear edges to thereby maintain a desired spacing between said panels.

4. A baffle arrangement as set forth in claim 1 wherein said fastening means comprises fasteners passing through said bracket and into the respective edges of said panels.

5. A baffle arrangement as set forth in claim 1 wherein at least one of said panels is susceptible to the occurrence of hot spots at a particular location on its surface, and further wherein said baffle member has attached thereto another baffle for diverting a portion of the circulated air over said particular location to prevent the occurrence of hot spots.

6. A method of attaching a bracket to a plurality of heat exchanger panels arranged in side-by-side relationship for the flow of circulation air over the outer surfaces thereof, said panels having rear edges disposed near a rear wall of the furnace, comprising the steps of:

providing an opening in each of a plurality of panel rear edges;

providing a bracket with a plurality of openings formed therein at selected locations;

placing said bracket in substantially transverse relationship over said panel rear edges so that said bracket openings register with said panel rear edge openings; and inserting fasters into said registered openings to secure said baffle to said panel rear edges.

7. A method as set forth in claim 6 wherein said plurality of panel rear edge openings comprise elongate pockets that extending in the plane of the heat exchanger panel.

8. A method as set forth in claim 7 wherein said pockets are generally cylindrical in form.

9. A method as set forth in claim 6 wherein said plurality of panel rear edge openings each comprise a pair of semi-cylindrical indentions formed in opposite sidewalls of the heat exchanger panel.

10. A method as set forth in claim 6 and including the additional step of installing a seal around said fasteners.

* * * * *